United States Patent [19]

Mino et al.

[11] 4,125,679

[45] Nov. 14, 1978

[54] PARTIALLY ALLOYED GALVANIZE PRODUCT

[75] Inventors: George M. Mino, Hamburg; Donald L. Dustin, Elma, both of N.Y.

[73] Assignee: Bethlehem Steel Corporation, Bethlehem, Pa.

[21] Appl. No.: 818,796

[22] Filed: Jul. 25, 1977

Related U.S. Application Data

[62] Division of Ser. No. 686,961, May 14, 1976, Pat. No. 4,059,711.

[51] Int. Cl.[2] ..... C23C 1/02

[52] U.S. Cl. ..... 428/659

[58] Field of Search ..... 428/659; 75/178 R, 178 A; 427/383 D, 321, 349, 329, 360, 433

[56] References Cited

U.S. PATENT DOCUMENTS

| | | | |
|---|---|---|---|
| 3,278,331 | 10/1966 | Taylor et al. | 427/321 |
| 3,320,040 | 5/1967 | Roe et al. | 75/178 R |
| 3,619,247 | 11/1971 | Newport et al. | 428/659 |

FOREIGN PATENT DOCUMENTS

| | | | |
|---|---|---|---|
| 4,004,134 | 7/1967 | Japan | 427/383 |

*Primary Examiner*—M. J. Andrews

*Attorney, Agent, or Firm*—Joseph J. O'Keefe; William B. Noll

[57] ABSTRACT

A partially alloyed galvanized ferrous strand and a method for its production. The method is characterized by the steps of immersing a clean and oxide-free ferrous strand in a molten zinc galvanizing bath to produce on the strand a coating weight of between 0.2 and 0.5 oz. per square foot. After immersion, the zinc-coated ferrous strand is heat treated and cooled to produce a galvanized coating on said ferrous strand, which coating has a duplex structure characterized by an iron-zinc intermetallic layer consisting essentially of the zeta phase, an overlay of free zinc, and an average iron content between about 2 and less than 4% by weight.

4 Claims, 1 Drawing Figure

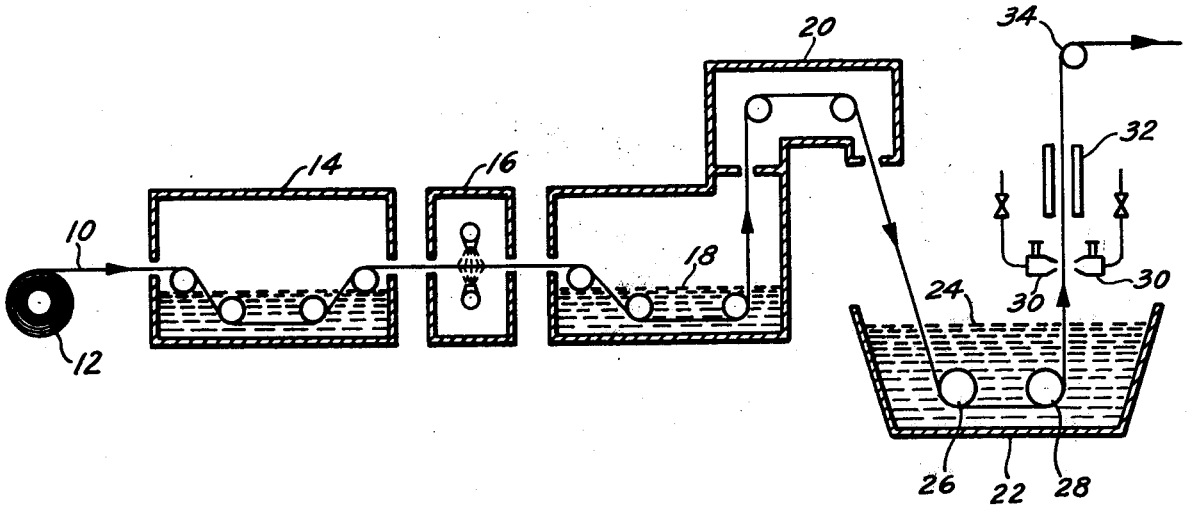
10
12
14
16
18
20
22
24
26
28
30
30
32
34

PARTIALLY ALLOYED GALVANIZE PRODUCT

This is a division of application Ser. No. 686,961, filed May 14, 1976 now U.S. Pat. No. 4,059,711, issued Nov. 22, 1977.

BACKGROUND OF THE INVENTION

This invention relates to an improved galvanized product which has ductility and paintability characteristics superior to galvanized products presently available. More particularly this invention relates to a continuous process for the production of such galvanized product wherein the galvanized coating is a duplex structure characterized by an iron-zinc intermetallic layer consisting essentially of the zeta phase,, an overlay of free zinc, and an average iron content between about 2 and less than 4%, by weight.

Continuous galvanizing has gained broad acceptance in the steel industry by virtue of its low production cost and galvanized products are broadly accepted by the consuming public because such products last longer than uncoated steel products in certain corrosive environments. Today millions of tons of galvanized strip are produced annually in the United States by continuous hot-dip methods. Such methods have been modified over the years to produce a variety of products having different characteristics.

Prior Art Continuous Galvanizing Process

Sendzimir, in U.S. Pat. No. 2,110,893 teaches a continuous galvanizing method whereby a ferrous strand, such as steel strip, is passed through a high temperature oxidizing furnace to produce a thin film of oxide coating on the steel strip. The strip is then passed through a second furnace containing a reducing atmosphere which causes a reduction of the oxide coating on the surface of the steel strip and the formation of a tightly adherent impurity-free iron layer on the steel strip. While the strip remains in such reducing atmosphere, the steel strip is immediately immersed in a molten zinc bath maintained at a temperature of about 850° F. (456° C.) The strip is then cooled in air, or by accelerated means, resulting in a bright spangled surface. The coating is characterized by a thin iron-zinc intermetallic layer between the steel base and a relatively thick overlay of free zinc. The iron content of the coating is less than about ½%, by weight.

There is a modified gas cleaning process that is practiced today for the production of galvanized steel. Such a process uses a Selas-type direct-fired furnace and avoids the initial high temperature oxidizing treatment of the Sendzimir process.

A third practice which has also gained acceptance for galvanizing steel strip is described in U.S. Pat. Nos. 2,824,020 to Cook et al., and in U.S. Pat. No. 2,940,870 to Baldwin. The practice described such patents includes the step of applying a flux to the strip to be galvanized. The flux reacts with the molten zinc bath to expose a clean oxide-free strip to the molten zinc bath.

From each of such processes there is produced a galvanized coating which is ductile. However, such coating has a major drawback in that its spangled surface is too rough to permit a smooth paint finish. Further, when painting is desired costly surface preparation is generally required.

Prior Art Modifications Galvannealed

To produce a non-spangled surface which is readily paintable, without further treatment of the surface, a high temperature post heat treatment was introduced for the coated strip. This process is known as galvannealing.

The preparatory steps and the coating step are identical to the spangled or unalloyed version. After the coating immersion step the coated strips follow different processing sequences. In U.S. Pat. No. 3,322,558 to Turner, a process is taught wherein the coated strip, as it leaves the galvanizing bath, is passed upwardly between rows of open burners. These burners are mounted in such a way as to minimize the effect of emissivity of the sheet and maximize heating of the strip by convection heat. This uniform heating of the strip at temperatures from 900° F. to 1200° F. (483° to 649° C.) results in a uniform dull finish where the coating surface is fully alloyed and has an iron content at the surface of from 8 to 12%, by weight.

In Mechler, U.S. Pat. No. 3,056,694, the zinc layer on the surface of the strip contains from about 4% to about 20% by weight of iron, with a coating weight varying between 0.5 and 1.5 oz. of zinc per square foot of strip. The coating is formed by heating a galvanized coated strip at a temperature of from 850° F. to 1500° F. (456° to 816° C.) for about 4 to 40 seconds.

In each of the above galvannealing processes, the zinc coated strip is heated to above the melting temperature of zinc, i.e. about 790° F. (421° C.), to accelerate the reaction of zinc with the coating base iron. This results in the growth of the intermetallic layer from the iron base to the surface. Thus, a characteristic of galvannealed strip is a fully alloyed coating and the absence of spangles. While the introduction of such galvannealing treatment appeared to provide an answer to improvements in the paintability of galvanized steel, a loss in coating ductility was found. Loss in ductility, evidenced by flaking or the appearance of a powdered residue following forming operations, is attributed to the presence in the coating of stable, but brittle, intermetallic iron-zinc alloy phases, such as the delta and gamma phases.

A review of the types of iron-zinc phases which may be present in a galvanized coating may be helpful to a fuller understanding of this invention. On the basis of the Equilibrum diagram of the Fe—Zn system, the following phases, with their corresponding iron contents, by weight, would form as iron from the ferrous strand diffuses into the molten zinc coating.

Table

| Phase | Chemical Structure | Iron Content |
|---|---|---|
| eta | Zn (free zinc) | .003% max. |
| zeta | $FeZn_{13}$ | 6 - 6.2% |
| delta | $FeZn_7$ | 7 - 12% |
| gamma | $Fe_5Zn_{21}$ | 22 - 28% |

The gamma phase is the most brittle of the intermetallic phases, while the zeta phae is the least brittle.

The present invention, for the first time, brings together the advantages of improved coating ductility and paintability through a controlled galvanizing process which results in a partially alloyed ferrous strand having an iron-zinc intermetallic layer consisting essentially of the zeta phase, and a surface layer of free zinc.

SUMMARY OF THE INVENTION

This invention relates to a galvanized ferrous strand and to the method of carefully controlling the alloying activity of zinc with the ferrous base in a continuous galvanizing operation. Such control, which results in a ferrous strand having a galvanized coating consisting of an iron-zinc intermetallic layer of predominantly the zeta phase, an overlay of free-zinc, and an average iron content between 2 and less than 4%, by weight, requires correlation of those parameters affecting the rate of growth of the iron-zinc alloy layer. Parameters which have been found to influence activity between zinc and iron are:

a. ferrous strip,
b. bath temperature and composition, and
c. post heat treatment The correlation of these parameters, to produce the product of this invention, will be detailed hereinafter.

BRIEF DESCRIPTION OF DRAWING

The FIGURE is a schematic representation of a preferred embodiment of a process for producing the composite galvanized product of this invention.

DETAILED DESCRIPTION OF PREFERRED EMBODIMENT

Preferred Processing Sequence

The processing of galvanized strip according to this invention may be carried out by such apparatus as set forth schematically in the accompanying drawing. In the FIGURE, steel strip 10 is fed from a coil 12 into a cleaning section 14 where surface contaminants and oxides are removed from the strip in a manner well known to those skilled in the art. The cleaning section may comprise tanks of caustic cleaner and dilute acid, such as HCl. Strip 10 then passes through a water rinse 16 which removes all traces of the cleaning solution. The clean strip is passed through a molten flux 18, such as zinc-ammonium-chloride, and continues through furnace 20 where the flux coated strip is heated to a temperature of about 500° F. (260° C.). The temperature is limited to that which will dry the flux in situ without burning it off the strip. Strip 10, which is protected against reoxidation by the dried flux, passes from furnace 20 through dipping pot 22 which contains molten zinc 24. The strip passes around sinker rolls 26 and 28 and exits between air wiping nozzles 30 which act to help control coating weights, which in this invention varies between 0.2 and 0.5 oz. per square foot of strip. The strip continues in this upward path through furnace 32 which heats the coated strip to a temperature below the melting point of zinc. The strip then is air cooled and passes over roller 34 to a coil rewind operation (not shown).

Controlling Alloying Activity

While the processing appears to follow a conventional hot dipping sequence, it was observed that changes could be imposed on such sequence whereby the alloying activity between the ferrous base and molten zinc could be controlled between the prior art extremes of limited alloying and total alloying. Through the present invention it was discovered that changes in, and/or the correlation of certain of the factors such as the character of the ferrous strand, bath temperature and composition, and post heat treatment, would result in a novel, galvanized product. This product, as produced by the continuous process disclosed herein, is characterized by a ferrous core and a duplex coating, which coating comprises an intermetallic iron-zinc alloy layer consisting essentially of the zeta phase, a superficial layer of free zinc, and an average iron content for the full coating of between about 2 and less than 4%, by weight, preferably between about 2.75 and 3.25%.

A. Ferrous Strip

The surface finishing on the incoming ferrous strip entering the molten zinc was found to have an effect on the activity of the iron-zinc alloying reaction. A preferred finish was found to be less than about 40 micro inches. While means are known and readily available to the worker skilled in the art to make such readings, it briefly is a measure, determined electronically, of the relative depths of peaks and valleys on the strip. Instruments are available by which an operator moves a vibrating crystal over the strip surface and the results thereof read on a gauge. By imposing such a finish on the incoming strip, it is possible to obtain an average surface finish of less than about 70 micro inches on the coated strip.

Another factor found to have an influence on the iron-zinc alloying activity is the deoxidation practice followed in producing the steel from which the strip is rolled. A killed steel is preferred as it was found to have a more reactive surface. When using a killed steel, greater aluminum additions are needed in the galvanizing bath, a factor to be discussed later. Rimmed steel, though suitable for processing according to this invention, presents a surface which is less reactive than found in killed steels.

B. Bath Temperature and Composition

Galvanizing baths are typically maintained at a temperature of 50° to 80° F. (28° to 44° C.) above the melting point of zinc, i.e., 790° F. (421° C.). This was found to be inadequate for the purposes herein. Heating of the molten zinc to a temperature in excess of 900° F. (483° C.), preferably between about 910° to 950° F. (485° to 510° C.), was observed to be a desired effect on the iron-zinc alloying activity.

While conventional galvanizing bath generally contain less than 0.15%, by weight, aluminum, balance zinc, the practice of the invention uses a greater percentage of aluminum to form the more adherent and ductile iron-zinc alloy.

C. Post Heat Treatment

The coated strip heat treatment followed in the practice of this invention is quite different from that found in the prior art galvannealing treatment. Heating furnace 32, according to this invention, heats the coated strip to a temperature below the melting point of zinc for a period of time to control the alloying action (development of the zeta phase) which had begun with the initial contact between the molten zinc and ferrous strip. A minimal post heat treatment is preferred. Furnace 32 supplies just enough heat to maintain the temperature of the coated strip, which temperature is between about 550° to 650° F. (288° to 343° C.), to promote the development of the less brittle zeta phase, while at the same time minimizing the growth of the brittle gamma and delta phases.

EXAMPLE

Steel strip (0.032 inches minimum gauge, 4513/16 inches × coil), whose chemical analysis, by weight, is as follows:

Carbon—0.06%
Manganese—0.33%
Aluminum—0.049%
Iron and Incidental Impurities—balance, was processed at a line speed of 270 f.p.m. on apparatus of the type shown in the drawing. The fluxed and dried strip was at a temperature of about 500° F. (260° C.) when it entered the molten zinc maintained at a temperature of about 950° F. (510° C.). The molten zinc contained 0.17%, by weight, aluminum, and a trace amount of lead. The post heating was conducted at 10% of the post heating furnace's capacity or an output of 800,000 BTU/hr. This was just enough heat to permit the continuance of the alloying activity. It was less than that which would have been required to fully alloy the coating, or melt the coating.

The strip was examined and found to have a light gray, reflective coating, a weight of 0.32 oz. per square foot of strip and an average surface finish of about 52 micro inches. Microscopically the coating revealed an intermetallic layer consisting essentially of "bursts" of zeta phase growing away from the ferrous core, an average iron content of about 2.75%, by weight, and a surface layer of free zinc.

By the operation of the processing controls enumerated above, there results a product which may be readily formed or drawn without flaking or powdering. The presence of the surface layer of free zinc means the surface is less porous than the fully alloyed, or galvannealed version. As a consequence, the product of this invention is more readily temper rolled to produce a surface texture, i.e., less than an average of 40 micro inches, which when painted with a high gloss paint is compatible with a cold rolled uncoated surface similarly painted. Further, the temper passing operation had little effect on the susceptability of the coating to powder or flake when formed or drawn.

We claim:

1. A hot dipped glavanized ferrous product having a duplex coating characterized by (a) a coating weight of between 0.2 and 0.5 oz. per square foot, (b) an iron content, by weight, of at least 2% but less than 4%, and (c) a surface layer of free zinc overlying an iron-zinc intermetallic layer of predominantly the zeta phase.

2. The galvanized ferrous product of claim 1 wherein the surface of the coating has an average finish of less than about 70 micro inches.

3. The galvanized ferrous product of claim 2 wherein the surface of the coating has an average finish of less than about 40 micro inches.

4. The galvanized ferrous product of claim 1 wherein the iron content of the galvanized coating is about 2.75 to 3.25%.

* * * * *